United States Patent [19]

Rios et al.

[11] Patent Number: 4,524,486

[45] Date of Patent: Jun. 25, 1985

[54] SELF-LOCKING, SELF-ALIGNING STEPPED SPRING HINGE PIN

[75] Inventors: Victor Rios, Little Neck; Henry W. Wolf, Malba, both of N.Y.

[73] Assignee: Pivot Metal Works, Inc., Brooklyn, N.Y.

[21] Appl. No.: 410,412

[22] Filed: Aug. 23, 1982

[51] Int. Cl.[3] ..... E05D 5/12

[52] U.S. Cl. ..... 16/381; 16/386; 383/34; 383/43

[58] Field of Search ..... 16/228, 229, 380, 381, 16/386; 383/34, 43; D8/382, 388

[56] References Cited

U.S. PATENT DOCUMENTS

| | | | |
|---|---|---|---|
| 713,338 | 11/1902 | Paquette | 16/381 |
| 1,589,004 | 6/1926 | Stone | 16/386 X |
| 1,607,205 | 11/1926 | Lord | 16/386 X |
| 2,817,871 | 12/1957 | Ferry | 16/381 |
| 2,903,033 | 9/1959 | Robinson . | |
| 3,068,508 | 12/1962 | Heyer | 16/386 |
| 3,110,057 | 11/1963 | Urich | 16/228 |
| 3,264,678 | 8/1966 | Parmelee | 16/228 |
| 3,593,364 | 7/1971 | Liautaud | 16/228 |
| 3,826,565 | 7/1974 | Wenzel | 16/228 X |
| 4,145,124 | 3/1979 | Weisgerber | 16/228 X |

FOREIGN PATENT DOCUMENTS

| | | | |
|---|---|---|---|
| 2102516 | 4/1972 | France | 16/386 |
| 1829 | of 1899 | United Kingdom | 16/386 |

OTHER PUBLICATIONS

Leonardi Mfg. Co., Inc.-six page advertising flyer-undated-title, "Frames".

*Primary Examiner*—Fred A. Silverberg
*Attorney, Agent, or Firm*—Ronald J. Sasiela

[57] ABSTRACT

A method and apparatus are disclosed for assembling spring frame hinges that utilize a pin having a tapered self-aligning section, a stepped midsection and a raised diameter stopping element. By harvesting the offsetting tension created by the hinge tang and curls the pin is easily inserted, lockingly held securely in place without the use of any additional fastening technique and yet can be non-destructively disassembled with little difficulty. In preferred embodiments of the invention audio confirmation that the pin has been properly inserted is achieved and a locking flush pin is disclosed.

1 Claim, 9 Drawing Figures

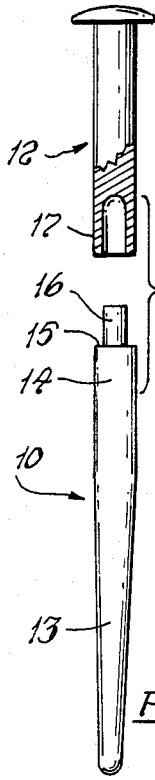
Fig. 1
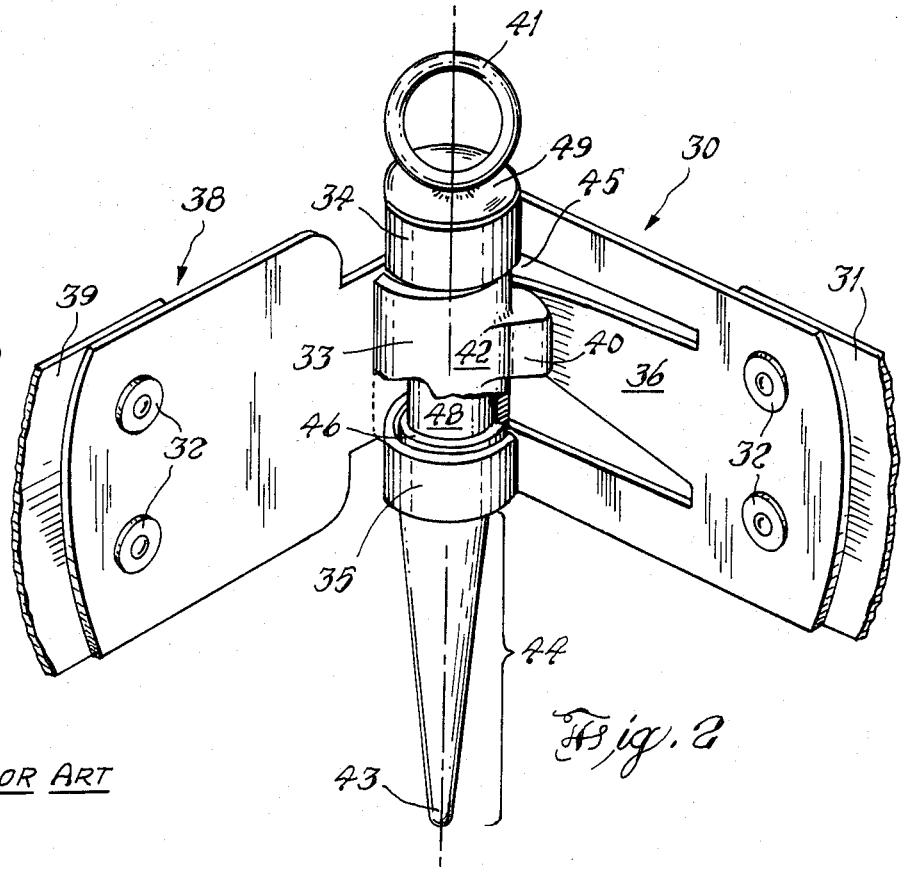
Fig. 2
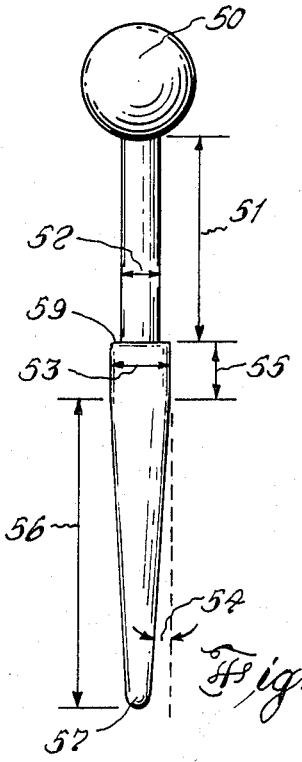
Fig. 3
Fig. 4
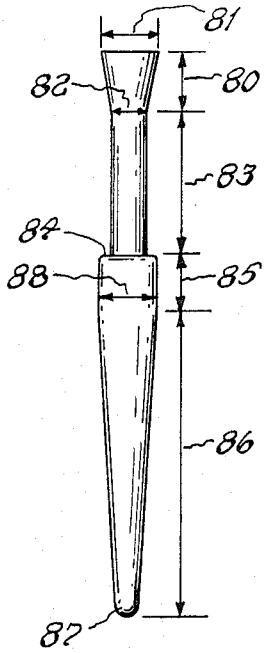
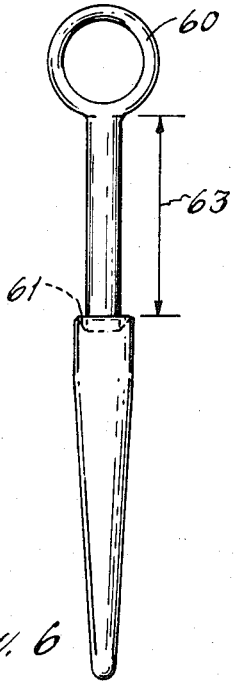
Fig. 6

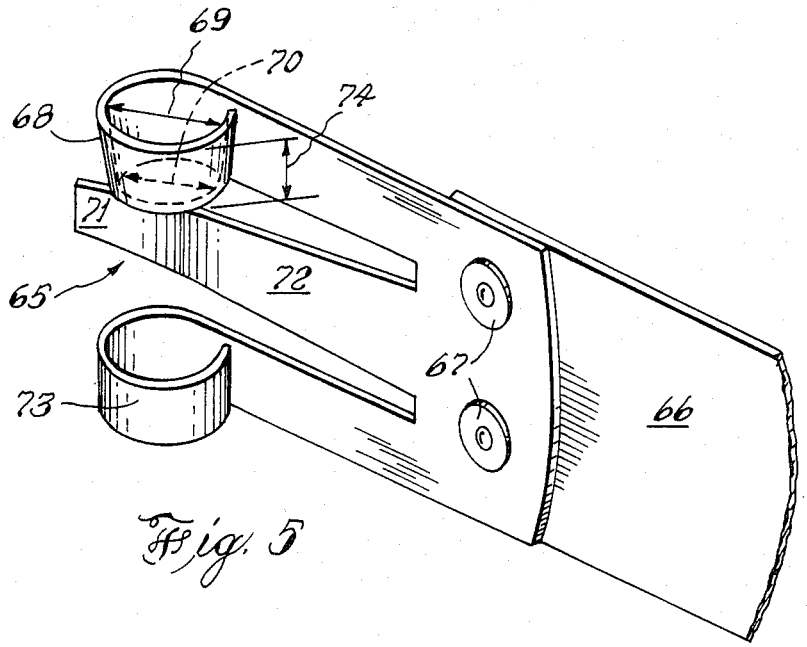
Fig. 5
Fig. 7
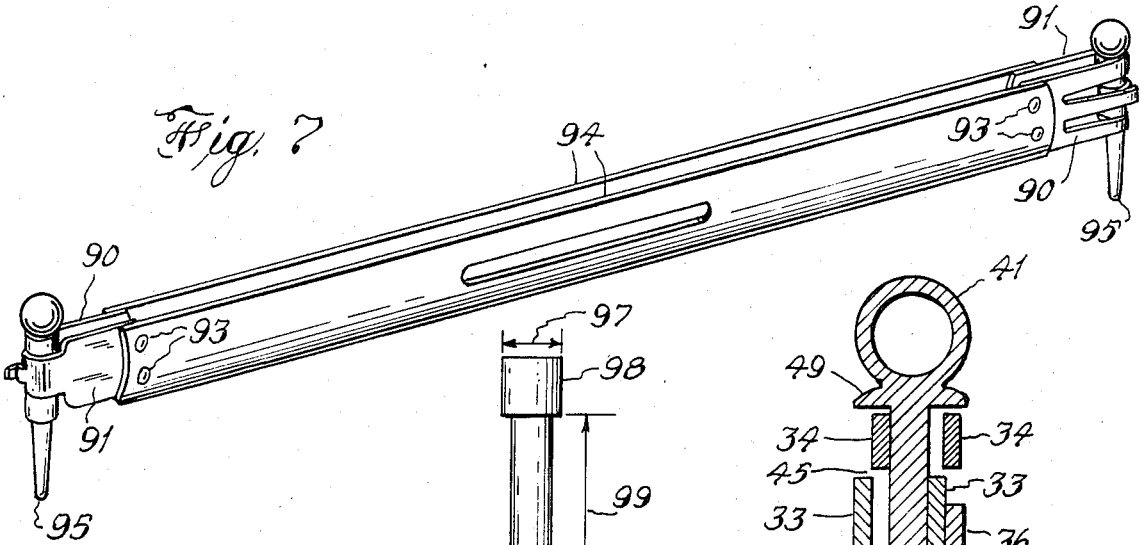
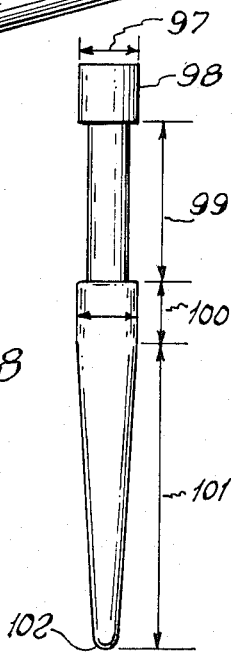
Fig. 8
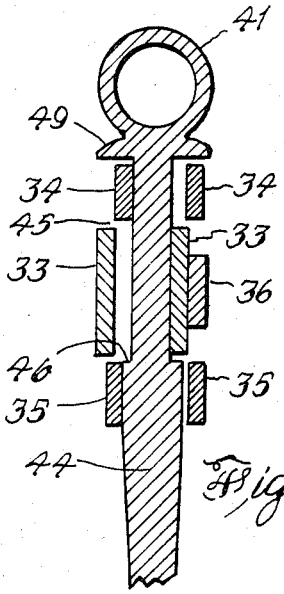
Fig. 9

SELF-LOCKING, SELF-ALIGNING STEPPED SPRING HINGE PIN

FIELD OF THE INVENTION

This invention relates to spring frames and, more particularly, to improved pin and hinge components thereof typically utilized in the manufacture of key cases, handbags, brief cases, eyeglass cases and the like.

BACKGROUND OF THE INVENTION

Clothing and accessory fashion brought about rapid changes in the direction of reduced use of heavy components and ornaments on items such as handbags, pocketbooks, attache cases, tobacco pouches, coin purses and similar soft cloth and leather products. In order to still effectively tightly close these new items without the use of an unsightly large clasp or zipper the so-called spring frame is ordinarily used. It consists generally of four components namely two mating spring steel hinge frames and two hinge pins. These parts are finally assembled at the time of completion of the article. For instance, each frame must be slipped into its individual pocket at each side of the intended handbag opening. Thereafter the hinge pin is inserted at each hinge. U.S. Pat. No. 2,903,033 discloses typical closure devices such as the frame, hinge and pin.

Conventional means for accomplishing this final assembly can take several forms. For instance, FIG. 1 illustrates an often used means consisting of a guide pin 10 and a rivet 12. The guide pin has a lower extended aligning tapered section 13, a cylindrical upper region 14, a platform 15 and a centering pin 16. The diameter and length of the centering pin are such that it snuggly occupies the provided recess of rivet 12 shown in cross section 17. The rivet is inserted onto the guide pin 19 and both are worked down into the hinge. The tapered section 13 aides in aligning the three hinge curls. The diameter of the guide pin at region 14 and rivet shank are the same. This allows for a smooth transition of the developing inherent tension as the wider upper diameter of the guide pin advances through the hinge from the guide pin onto the rivet. The height of the rivet is such that as the bottom of the rivet emerges from the hinge the guide pin no longer is tensionably held in communication with the rivet and by gravity drops off. Subsequently the reusable guide pin must be retrieved from the assembled product. The assembly is not considered complete because the rivet pin, under the tension and rotational movement of the working hinge about the inserted rivet could be caused to ride up out of the hinge and become dislodged. To avoid this problem, in an additional step, the rivet recess 17 is flared out by the action of an aligned anvil tip and hammer. Its radial dimension is thereby increased beyond that of the internal diameter of the spring hinge. This awkward flaring process, now inside the crowded end of the assembled piece, can result in the rivet flare interfering with full rotational movement about the rivet. Furthermore, if an error was made in the assembly it becomes difficult to remove the flared rivet.

Another method of final frame assembly calls for the use of a blunt nosed pin. The nose radius is typically that of the cylindrical upper portion of the hinge pin. Since there is no tapered aligning section in this pin the tension of the hinge is generally overcome by applying jaw pressure via a foot press to the hinge components. This squeezes them together, aligns the openings of the three curls and permits reduced effort in driving the leading hemisphere blunt nosed pin "home". Unfortunately under the action of the jaws used to align the hinge curl holes, problems can develop. Initially, the proper location for the jaws to be positioned is difficult to establish since the hinge is not generally visible this time being covered with non-transparent material, such as cloth, plastic or leather. Also an oversqueeze of the hinge develops a set in the tang spring thereby reducing its effective force. Once this type hinge pin has been inserted it usually is secured in place by a second procedure wherein the assembled piece must be first opened and then a cap nut is forced over the blunt nose. The cap nut can be held in place by a score line provided around the lower end of the hinge pin. If a strap, handle, etc. is to be used to carry the final item it is imperative that the pin be securely locked in place.

If only two of the three hinge curls are "caught" by the inserted pin it could go undetected as visually the misaligned bottom curl is hidden deeper within the recess of the assembled item. Obviously the hinge under that circumstance would be inoperable and/or damaged. Since the curls of conventional spring hinges are essentially cylindrical the opportunity exists for the aforementioned misalignment to occur.

Accordingly, it is therefore an object of the present invention to provide an improved method and apparatus for assembly of spring hinges and frames which will serve to avoid restricted rotational movement.

A further object of the invention is to allow for a single step assembly of spring hinges; eliminating the prior multi-step process.

An additional important object of the invention is to provide for a new unique hinge pin which is both self-aligning and self-locking, that becomes a part of the final assembly and does not require the use of any additional fastener or process.

Yet another object of the instant invention is to provide for audio confirmation that the new pin has been properly assembled in all the intended curl elements of the spring hinge.

Another object of the invention is to enable final assembly of the end product from the outside only thereby not necessitating entry into the completed item.

It is still a further object of the invention to provide for a spring hinge pin that is secure and self-locking yet can be disassembled easily and in a totally nondestructive manner.

Another object of the invention is to provide a spring hinge and pin which allows for a flush finish in the assembled parts.

SUMMARY OF THE INVENTION

Briefly the instant invention eliminates the drawbacks of the conventional spring hinge pin construction and assembly discussed above by providing for a unique pin having three essential features. These are identified as a lower conical section, a reduced stepped mid-section and a stopping element.

The conical section initially allows for alignment of the upper and middle curls of the hinge. By leverage action from the top of the pin, and with assistance as required by moderate squeezing pressure at the hinge to reduce the tension being developed, the stepped pin mid-section enters the upper hinge curl. As additional manual pressure is applied at the top of the pin the step is both felt and heard to skip from the edge of the lower curl onto the off-set middle curl. In a preferred embodiment of the pin design the stepped mid-section would also likewise skip from the bottom of the middle inner curl onto the upper region of the second curl, thereby affording an additional measure of security against the pin escaping movement. Further passage of the pin through the hinge curls is afforded by a stopping element which typically would be an ornamental sphere, flat plate, ring for the subsequent attachment of a handle or the like. The only requirement that the stopping element have is that its maximum cross-sectional dimension be greater than that of the stepped midsection of the pin. The design of the step platform can be an abrupt 90°, or less or more depending upon the desired locking intensity for that pin.

In a further embodiment of the present invention, the spring hinge pin has a conical stopping element which is received by an upper hinge curl which is also conical. The terminal alignment of the pin is thereby improved and allows for the top of the pin to finish flush with the plane of the upper curl.

BRIEF DESCRIPTION OF THE DRAWINGS

Further objects and advantages of the present invention can be more fully appreciated by reference to the following detailed description and drawings, wherein:

FIG. 1 is an illustration of a separated typical flat-top rivet and guide pin of prior art, with a rivet broken away.

FIG. 2 is a portion of a perspective view of an opened hinge utilizing a pin constructed in accordance with the present invention; partially broken away at the region of the juncture of the single curl and lower double curl.

FIG. 3 is a front view of the hinge pin of the present invention with a sphere as its stopping element.

FIG. 4 is a front view of the hinge pin with an upper conical stopping element to be employed in conjunction with the double curl hinge of FIG. 5.

FIG. 5 is a perspective view of a portion of a double curl hinge as made to receive the pin of FIG. 4.

FIG. 6 is a front view of a hinge pin made in accordance with the principles of the present invention and having a ring as its stopping element.

FIG 7 is a perspective view showing a typical final assembly of a complete closed spring hinge using two pins of FIG. 3.

FIG. 8 is a front view of a recessing hinge pin of the invention utilizing a cylindrically headed pin.

FIG. 9 is a partial sectional view of the hinge, pin and tang of FIG. 2 illustrating in further detail the stepped pin midsection as well as the double and single curls positioned thereon.

DETAILED DESCRIPTION OF THE PREFERRED EMBODIMENTS

Referring now to the drawings, FIG. 2 best illustrates the working components of the fully assembled hinge. It can be seen that the double curl hinge element generally shown as 30 is here illustrated fastened to its spring steel extension 31 by two rivets 32. Between the upper curl 34 and lower curl 35 is the hinge tang 36. The single curl hinge element, generally show as 38 likewise is fastened to its spring steel extension 39 by rivets 32. The curl 33 itself can be seen to have cam 40 protruding outwardly therefrom. The flat top ring hinge pin 41 is of the same design as the pin of FIG. 3 except for the different stopping element atop the pin.

The hinges 30 and 38 are typically made of high carbon steel, heat treated and tempered. Since they will generally be visible they are electroplated to offer an attractive finish. After the two hinge elements are inserted into their respective receiving pockets at the mouth of the intended article the hinges are brought close together and approximately parallel to one another. FIG. 7 shows this uncovered arrangement but already pinned. In this assembly position the tang 36 rests in the area 42 which does not have the cam elevation as found at 40. The cam therefore does not substantially interfere with the alignment of the holes formed by curls 34, 33, and 35. Nevertheless the holes typically only overlap and intersect partially because of a slight inward offset at the tang. After the hinges are brought together the lower tapered end 43 of pin 41 is inserted into the upper curl 34. Continued pressure is applied and the tip enters the single curl 33. As pin 41 advances it exerts pressure against the interior wall of curl 33 which in turn deflects the tang 36 bringing the curls further into alignment. The tip 43 is made to continue until the entire self-aligning zone 44 of the pin has passed into the curls. At this position the tang 36 is tensioned against area 42 making the single curl hinge element 38 offset 45 from the double curl element 30. There is typically a desired amount of "play" in a hinge of this type. As the pin is still further advanced into the hinge the step of the pin 46 passes from the lower edge of upper curl 34 onto the upper edge of single curl 33. The instant that this occurs a clicking sound is heard and the pin is felt, if manually inserted, to absorb the tang's energy in the transition onto the stepped midsection of the pin 48. The pin is already actually locked in place, even though only being partially inserted. The step 46 finds itself located partly under the arc of curl 34, generally diametrically across from the point on curl 33 where tang 36 rides. The amplitude of the acoustical confirmation that the pin has ridden off curl 34 onto curl 33 is primarily a function of the tang tension, the clearance within curls 34 and 33, the width of the step 46 as well as the shape of the step. These latter two design variables will be discussed at greater length later in this description. The tang tension causing the offset 45 of the curls 34 and 33 causes upper curl 34 to relax slightly once the step 46 has cleared it. Curl 34 now rests on the stepped midsection of the pin 48. Any attempt to remove the pin is found to meet with considerable resistance because step 46 is intersecting a portion of the lower rim of curl 34 and is tensionably being positioned there. Continued advancement of pin 41 into the hinge similarly meets with a second audio signal at the transition of step 46 from the lower edge of curl 33 onto curl 35. The step 46 now finds itself partly under the arc of curl 33, at the area of tang 36—180° opposed to where the locking region was identified earlier. Curl 35 now exerts a leverage type force on the pin at the upper region of self-aligning zone 44 keeping it offset as at 45.

The stepped midsection 48 of pin 41 has a height measured from the underside of head 49 to step 46 being slightly greater than the height from the top of curl 34 to the bottom of curl 33. This relationship assures that both locking positions would be utilized. The pin 41, as another embodiment of the invention, could have had the stepped midsection 48 height shorter. For instance, it need be, at the least, only taller than the maximum height of upper curl 34. In this variation the pin would have had but one opportunity to be locked in place.

Conversely, the stepped midsection 48 could have been taller, having a height greater than the maximum distance between curls 34 and 35. The step 46 of pin 41 would then terminally rest under the lower edge of curl 35 affording the hinge a total of three locks. The corresponding degree of security therefore can be selected from options depending upon the need. The assembly of the spring hinge frame would be as mentioned appearing in FIG. 7. As the center of the spring steel is pulled apart the tang 36 which has been resting against area 42 when in the closed position now begins to ride onto cam 40. Once the resistance is overcome and upon being opened to an approximate angle of 90° the tang rests on the level portion of 33 with a portion of the tang also resting on the side of cam 40. This position keeps the finished article in an unattended open position. To close the article the steel frame is again grasped in the center and as the hinges freely rotate about the pin the tang rides over the cam and securely brings the two parts together once again. The force associated with which these two operations are accomplished is regulated by those skilled in the art by varying the tang set, cam height and location, pin clearance, spring steel design, etc.

Referring to FIG. 9, which is a sectional view taken through the pinned hinge of FIG. 2, the final traverse relationships of the curls and pin can be appreciated. The tension created by double curl tang 36 contacting and acting against single curl 33 causes it to be lockingly held in place over step 46. A clearance between the stepped midsection 48 and curl 33 is necessarily developed diametrically across from the tang. Likewise double curl elements 34 and 35 are tensionally held respectively against the midsection 48 and upper region of the self-aligning zone 44.

In the embodiment shown in FIG. 3 the self-aligning, self-locking pin 41 of FIG. 2 has been modified to have a sphere 50 as its stopping element instead of the flat top ring design. The pin of FIG. 3 additionally consists of the stepped mid-section 51 whose diameter 52 is less than that at 53, the pin region juxtapositioned to the stepped midsection. The pin of FIG. 3 is also shown with provision for a region 55 having a cylindrical shape with diameter 53. Longitudinally beyond region 55 is included frustoconical portion 56 which tapers from a maximum diameter adjacent region 55 to a minimum diameter at the rounded free end 57 of the pin. The length of this tapered section 56 can be greater than the height of the curls, which in FIG. 2 would be the outside distance between curls 34 and 35. Likewise its shortest length need be no more than the length of the lower curl 35. The angle that the taper makes with the vertical 54 can vary from very small, about 5°, up to an effective angle of 90°. This angle governs the length of the self-aligning region of the pin. Thus, small angles result in a longer tapered pin which is easier to insert while larger angles result in a shorter tapered pin requiring correspondingly more care in the external application of force necessary to properly align the hinge curls beforehand. Even if the bottom of the pin were perfectly flat, the stepped midsection 51 would still provide a unique positive locking arrangement for the pin.

The pivot pin as described in FIG. 3, as well as other embodiments mentioned herein, can be made of any suitable rigid material, such as aluminum, plastic, steel, alloys and the like. Further, the pin elements can also be separately machined and then secured together before or during the finished article final assembly. For instance, the sphere 50 could be welded onto the stepped midsection 51 if they had been individually made. The pin could be die cast from a zinc aluminum alloy and be electroplated thereafter in order to attain an attractive luster. If made from plastic, the injection molding technique could be used with or without plating thereafter.

The diameter of sphere 50, in order to remain visible, would have a maximum diameter greater than the internal clearance of the spring hinge curl. The stepped midsection 51 diameter 52 is typically reduced from that found at diameter 53 so strength is retained in the pin and excessive play is not developed between the curls and midsection 51. An excessively reduced diameter 52, unless compensated for elsewhere, could adversely affect the workings of the spring tang and cam. The length of the stepped midsection 51 can be varied greatly, as explained in detail above, depending upon the degree of security necessary at the hinge. For example, a light weight coin purse may use a shorter stepped midsection, while a heavy handbag with a strap attached may require a stepped midsection the full length of the entire hinge in order to securely support the anticipated weight.

The cylindrical region of the pin 55 is regarded as optional to the basic elements of the invention. Its purpose is to center the pin at the lowest hinge curl, increase the bearing surface on which the curl rides and serve as the outermost surface defining the raised step 59. The pin can be constructed with the tapering frustoconical portion directly adjacent step 59. Although illustrated as having two 90° angles at the step 59, embodiments of the invention could have greater or lesser angles with their corresponding attendant change in locking power. For instance, if step 59 is inclined with its surface adjacent midsection 51 to be closer the free end 57 a recessed rim is formed next to the lowermost end of midsection 51. Conversely if step 59 surface is inclined toward stopping element end 50 a gradual step from midsection 51 onto cylindrical section 55 would result. The latter design would have less, while the former more, locking potential than that achievable with the pin of FIG. 3.

The pin of FIG. 6 is similar to that in FIG. 2 and 3 except that the stopping element is a ring 60. Also the step 61 is not perpendicular to midsection 63 but forms an acute angle therewith as described above. A portion of the lowermost arc of the ring 60 will rest within curl 34. The orientation of the ring 60 with respect to the final article opening could be controlled by notching the curl 34 or the straight band forming it. Another technique for orientation of a hole or ring that is used in the art calls for the attachment of a feature to the head of the pin which resembles an inverted "L". The long arm of the "L" is attached to the pin via the short arm of the "L". The long arm then rests within the article and is kept orientated when the two spring frames are closed.

The diameter of the stepped midsection and the conical shape of the self-aligning portion of the pin have been described with a certain amount of particularity. However, it should be understood that any cross sectional shape can be utilized without departing from the concept of the present invention. For example a square, rectangular, oval, triangular or regular polygon can be substituted for that illustrated. A fluted surface, likewise, would provide means for achieving the same functional desired result.

FIG. 8 illustrates a modification of the pin of FIG. 3 wherein the stopping element has been reduced in size to where it actually becomes completely recessed within the topmost curl of the assembled hinge. The head 98 would have a diameter 97 less than the internal clearance of the curl. Stepped mid-section 99 would correspond to a length at least greater than the height of the single curl. Region 100, also having diameter 97, would be where the lower curl of the double curl hinge would come to rest. The tapered section 101 and free end 102 aid in insertion of the pin as earlier discussed.

Turning now to further embodiments of the present invention, attention is directed to FIGS. 4 and 5. In FIG. 5 is shown a modified double curl spring hinge component. In like fashion to that described for FIG. 2, the hinge 65 has been fastened to its partially shown flexible spring steel member 66 by rivets 67. The upper coil 68 can be seen to be conically shaped unlike the cylindrical shape curl 34 generally used. Closer examination of curl 68 reveals that its frustoconical upper internal diameter 69 is larger than the lower internal diameter 70. The slight aformentioned set 71 in tang 72 provides the spring action when hinge 65 cooperates with a single curl hinge component such as seen at 38 in FIG. 2. The second curl 73 is of conventional design. Curl 68 has a height 74. In order to create curl 68 it would be desirable to remove a small quantity of excess material from the lower leading edge of the band intended to ultimately become curl 68. The reason being the small circumference 70 requires less material than necessary to create the larger diameter 69 and, in fact, if not removed could interfere with proper alignment with the single curl component of the hinge as well as curl 73.

The pivot pin of FIG. 4 is designed to be used in conjunction with hinge component 65 when a flush finish is desired at the hinge. It has a frustoconical stopping element 80 with a free end diameter 81 and a truncated diameter 82. The stepped midsection 83, step 84, cylindrical portion 85, conical section 86 and tip 87 complete the pin. For use along with the hinge component of FIG. 5, the pin outside diameter 88 must be less than the lower diameter 70 of curl 65. This will allow the entire self-aligning portion of the pin to travel thru curl 68. The height of the stopping element 80 is the same as the curl height 74. Upper pin diameter 81 is slightly less than curl diameter 69 and lower pin diameter 82 is similarly less than the curl diameter 70 providing for a more centered pin that is flush across the upper curl opening.

FIG. 7 depicts the final typical assembled hinge utilizing the sphere topped pin of FIG. 3. The double curl components 90 and single curl components 91 are connected via rivets 93 and the spring steel bands 94. It is to be realized that the assembly of FIG. 7 would ordinarily be covered with material at the opening of the article in question but is exposed herein to fully explain the invention features. In order to disassemble this hinge, as might become necessary if an error were made in the final article construction or a repair were required, a simple procedure is followed. A slight squeezing pressure is applied to the sides of hinge components 90 and 91 while simultaneously providing an upward pressure to pin tip 95. The pin is surprisingly found to be removable relatively easily, generally without the use of any tools. Furthermore, the pin as well as the hinge components have not been destroyed as is the case with prior art disassembly of fastened hinges.

While the invention has been described with a certain degree of particularity, it will be understood that the description was by way of example only, that the principles of the present invention would be adaptable for spring steel hinges of any size or shape, and that numerous variations and modifications, as may become apparent to those skilled in the art, can be made without departing from the scope of the invention as hereinafter claimed.

We claim:

1. A substantially rigid, self-aligning, self-locking spring hinge pin comprising, (a) a leading section having a cylindrical section and a truncated section, the cylindrical section having a first diameter, said leading section tapering away from the cylindrical section to a rounded section, wherein the rounded section has a second diameter which is smaller than the first diameter, the truncated section has a taper which is angled to a longitudinal axis of the pin, (b) a stepped mid-section having one end being directly connected to said cylindrical section, said stepped mid-section having a surface extending along the longitudinal axis, (c) a stopping element being directly connected to the other end of the stepped mid-section, said stopping element having a radial dimension greater than that of the stepped mid-section, and (d) a raised step is formed at the connection between said cylindrical section and the stepped mid-section, said step being inclined from the stepped mid-section toward the stopping element and away from the rounded section at an acute angle to the surface of said stepped mid-section to form a brim on the cylindrical section.

* * * * *